United States Patent [19]

Guntly et al.

[11] Patent Number: 5,049,318

[45] Date of Patent: Sep. 17, 1991

[54] CARBURETOR ASSEMBLY

[75] Inventors: Thomas G. Guntly, Hartford; Mark E. Federspiel; Michael J. Kurth, both of West Bend, all of Wis.

[73] Assignee: Tecumseh Products Company, Tecumseh, Mich.

[21] Appl. No.: 545,136

[22] Filed: Jun. 26, 1990

Related U.S. Application Data

[63] Continuation of Ser. No. 267,019, Nov. 4, 1988, abandoned.

[51] Int. Cl.[5] ..... F02M 5/12

[52] U.S. Cl. ..... 261/34.1; 261/71; 261/72.1; 261/DIG. 38; 261/DIG. 57

[58] Field of Search ..... 261/72.1, DIG. 38, DIG. 57, 261/34.1, 71; 72/268

[56] References Cited

U.S. PATENT DOCUMENTS

| | | | |
|---|---|---|---|
| 1,615,398 | 1/1927 | Mock et al. | 261/72.1 |
| 1,625,867 | 4/1927 | Plant | 261/DIG. 54 |
| 1,761,074 | 6/1930 | Edwards | 261/72.1 |
| 1,780,948 | 11/1930 | Sherman | 264/209.1 |
| 1,931,259 | 10/1933 | Kirby | 261/41 |
| 2,319,739 | 5/1943 | Kessler | 137/454 |
| 2,512,225 | 6/1950 | Demer | 261/71 |
| 2,544,289 | 3/1951 | Andrews | 261/72.1 |
| 2,674,373 | 4/1954 | Latin | 72/268 |
| 2,701,709 | 2/1955 | Brunner | 261/41 |
| 3,093,699 | 6/1963 | Demitz | 261/72.1 |
| 3,188,060 | 6/1965 | Kalert, Jr. | 261/72.1 |
| 3,215,413 | 11/1965 | Szwargulski et al. | 261/72.1 |
| 3,231,250 | 1/1966 | Kalert, Jr. | 261/72.1 |
| 3,284,066 | 11/1966 | Biver | 261/72.1 |
| 3,338,565 | 8/1967 | Heid | 261/70 |
| 3,731,517 | 5/1973 | Johnson | 29/DIG. 47 |
| 3,743,253 | 7/1973 | Tuckey et al. | 261/34.1 |
| 3,780,996 | 12/1973 | Nutten | 261/72.1 |
| 3,825,238 | 7/1974 | Nishihara et al. | 261/66 |
| 4,003,968 | 1/1977 | Rickert | 261/35 |
| 4,055,609 | 10/1977 | Phelps | 261/DIG. 57 |
| 4,113,073 | 9/1978 | Lusa et al. | 29/DIG. 47 |
| 4,235,828 | 11/1980 | Howes | 261/DIG. 57 |
| 4,447,371 | 5/1984 | Busch | 261/53 |
| 4,496,497 | 1/1985 | Satoh | 261/72.1 |
| 4,518,542 | 5/1985 | Rogers | 261/34 |
| 4,578,228 | 3/1986 | Gerhardy | 261/41 |
| 4,776,988 | 10/1988 | Neal | 261/34.1 |

FOREIGN PATENT DOCUMENTS 981291 1/1951 France .

*Primary Examiner*—Tim Miles

*Attorney, Agent, or Firm*—Jeffers, Hoffman & Niewyk

[57] ABSTRACT

A carburetor assembly which has a body formed of extruded aluminum and a plastic fuel bowl assembly secured to the body by means of a resilient spring clip. A gasket is located between the body and the fuel bowl. The fuel bowl is molded of plastic and includes an integral well, and a mixing screw housing as well as a primer housing. A plastic nozzle extends from the well through the venturi insert into a through passage into the body. The venturi insert is made of plastic material and includes molded grooves therein which form passages with the through passage of the body. The nozzle is resiliently urged against the gasket and the body by means of a spring located in the well thereby sealing the nozzle to the body.

34 Claims, 5 Drawing Sheets

CARBURETOR ASSEMBLY

This is a continuation of application Ser. No. 267,019, filed Nov. 4, 1988, now abandoned.

BACKGROUND OF THE INVENTION

This invention relates to carburetors for internal combustion engines and in particular to carburetors for small internal combustion engines such as are used in lawnmowers, snowblowers, generators, pumps and the like.

Prior art carburetors generally include a die-cast body made, for instance, from cast aluminum or zinc to which a fuel bowl assembly is secured by means of threaded fasteners. A disadvantage of this prior art carburetor construction is the high cost of manufacturing the die-cast aluminum body. Cost is incurred not only by casting the body but also by machining of the cast body to provide numerous passages and apertures. Another disadvantage of such prior art die-cast aluminum bodies is that die cast aluminum is often porous so that such die-cast aluminum bodies must be impregnated with a special sealing material. Other die-casting materials have also been used, such as, for instance zinc which is less porous than aluminum. However, zinc is both higher in weight and cost than aluminum and is therefore not a preferred material since it is important to make small internal combustion engines light in weight, particularly those engines which are used in hand-held or easily maneuvered equipment, such as leaf blowers, lightweight snowblowers, lawnmower and the like.

The fuel bowls of prior art carburetor assemblies have generally been made of either stamped steel or aluminum. Completely molded plastic prior art carburetors have also been provided in an attempt to reduce the machining and the overall number of separate components required for a carburetor. By manufacturing the entire carburetor from plastic, many of the details which would normally be machined may be molded in. However, it is difficult to mold certain of the orifices and other features which must be held to required close tolerances such as, for instance, $\pm 0.001$ of an inch, especially those with spans of 0.250 inch and up.

Two items which are particularly difficult to mold in plastic carburetors are the throttle bore and the throttle shaft bore. Both of these bores must be held to very tight tolerances and their alignment in the carburetor body is critical. Good performance of a carburetor requires a true throttle bore, especially in a full progression carburetor. Even if close tolerances can be held during the plastic molding process, in time, after the plastic structure has been subjected to thermal cycling and/or stress under load, the plastic material tends to deform due to plastic creep and the tolerance limits are therefore exceeded. Manufacturers have attempted to avoid this problem by eliminating certain functions from the carburetor such as for instance an idle system, thereby both limiting performance capabilities and avoiding the need for precision bores.

In some plastic carburetor structures, the throttle bore, throttle shaft bore and idle progression holes are machined in an aluminum portion of the carburetor in order to ensure close tolerances. In another attempt to improve the performance of molded plastic carburetors, high quality glass reinforced plastic or mineral filled plastic materials have been used. However, such filler materials make drilling and machining of the plastic carburetor very difficult. Furthermore the cost of high quality plastic can be as much as the cost of aluminum.

Still another problem with prior art plastic carburetors has been that the performance of some plastics will deteriorate by contact with gasoline, gasoline/alcohol blended fuels, and especially decomposing gasoline which generates acids and peroxides Other problems with prior art carburetors have been the cost of assembly which generally involves numerous gaskets and 0-rings, threaded fasteners, and press fit components. Another major problem has been difficulty of servicing the carburetor. Prior art carburetors generally needed to be completely disassembled from the engine in order to be serviced. In order to reassemble the carburetor to the engine, all linkages had to be reconnected and readjusted, all of which was time consuming.

It is, therefore, desired to provide a carburetor for small internal combustion engines which is low in cost, has excellent performance, is simple to assemble and is easy to service.

SUMMARY OF THE INVENTION

The carburetor assembly of the present invention, in one form thereof, includes an extruded aluminum body, a molded venturi which is inserted into the extruded body, a molded plastic fuel bowl and a spring clip which holds the fuel bowl to the body.

The carburetor assembly according to the present invention, in one form thereof, comprises a body formed of extruded aluminum and having a through bore therein. A molded plastic venturi is inserted into the through bore and, by virtue of a groove in its exterior surface, forms a passage with the extruded body for the flow of fluids therethrough. The amount of machining of the extruded body which is required is held to a minimum. The fuel bowl is molded out of plastic and is provided with locating studs whereby the fuel bowl is positively located on the body. A spring clip secures the fuel bowl to the body. A gasket is inserted between the fuel bowl and the extruded body to provide a proper seal. A plastic molded nozzle is received in a well which is molded integrally with the fuel bowl. The nozzle extends out of the fuel bowl and through an aperture in the extruded aluminum body and through another aperture in the molded venturi, thereby locating the venturi. The fuel bowl is additionally provided with a fuel inlet and, in one embodiment, with an idle mixture screw and a main mixture screw. Alternatively, the fuel bowl may be provided with a molded primer housing in which a primer bulb is mounted.

An advantage of the present invention is that it provides a low cost carburetor assembly which has excellent performance and is very simple to assemble whereby manufacturing of the carburetor may be automated.

Another advantage of the present invention is that the extruded aluminum carburetor body is relatively easy to machine by virtue of its extruded shape.

Still another advantage of the present invention is that by the use of a molded plastic venturi insert various sized venturis may be used for the same extruded carburetor body whereby the carburetor may be adapted for various engines.

Yet another advantage of the present invention is that the molded plastic carburetor fuel bowl may be removed from the engine without removing the carburetor whereby the carburetor may be serviced without disconnecting of linkages and controls, and the subsequent necessary reconnection and adjustment thereof. Additionally, few tools are needed to disassemble the carburetor.

Another advantage is that the spring clip maintains sealing pressure on the gasket even after the gasket has taken a compression set.

Yet still another advantage of the present invention is that the cost of required tooling to manufacture the carburetor is much lower than the tooling required for prior art carburetors.

A further advantage of the carburetor according to the present invention is that the venturi insert is so designed that it is sealed in the through bore of the carburetor body without the use of sealing compounds, 0-rings, or the like.

Still a further advantage of the present invention is that the idle and power mixture screws are self-tapping but are designed so 0-rings keep chips from tapping out of critical areas. They have specially shaped tips to form orifices in the fuel mixing circuit.

A still further advantage of the present invention is that the extruded aluminum carburetor body does not need to be impregnated with sealing material as was the case with prior art die cast aluminum carburetor bodies.

Yet a further advantage of the present invention is that the carburetor nozzle assembly has been so constructed that it is constantly biased or urged into contact with the aluminum body for proper sealing thereto by means of a bias spring. Thus the tolerances in the design are taken up by the biasing action of the spring and the use of threads and the like to assemble the nozzle to the carburetor is avoided.

The present invention, in one form thereof, comprises a carburetor assembly including an extruded body, the body including a through passage having an air inlet. A fuel bowl is secured the body and means is provided for conducting fuel from the bowl into the through passage.

The present invention, in one form thereof, comprises a carburetor assembly including extruded body wherein the body has a through passage therein adapted to admit air into the body. A venturi member is mounted in the through passage. A fuel bowl is secured to the body. A nozzle is provided for conducting fuel from the bowl into the venturi member.

The present invention, in one form thereof, comprises a carburetor assembly including a body having a through passage therein. A fuel bowl assembly is secured to the body by means of a resilient clip. A tube is provided for conducting fuel from the fuel bowl assembly into the through passage.

BRIEF DESCRIPTION OF THE DRAWINGS

The above-mentioned and other features and objects of this invention and the manner of attaining them will become more apparent and the invention itself will be better understood by reference to the following description of an embodiment of the invention taken in conjunction with the accompanying drawings wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
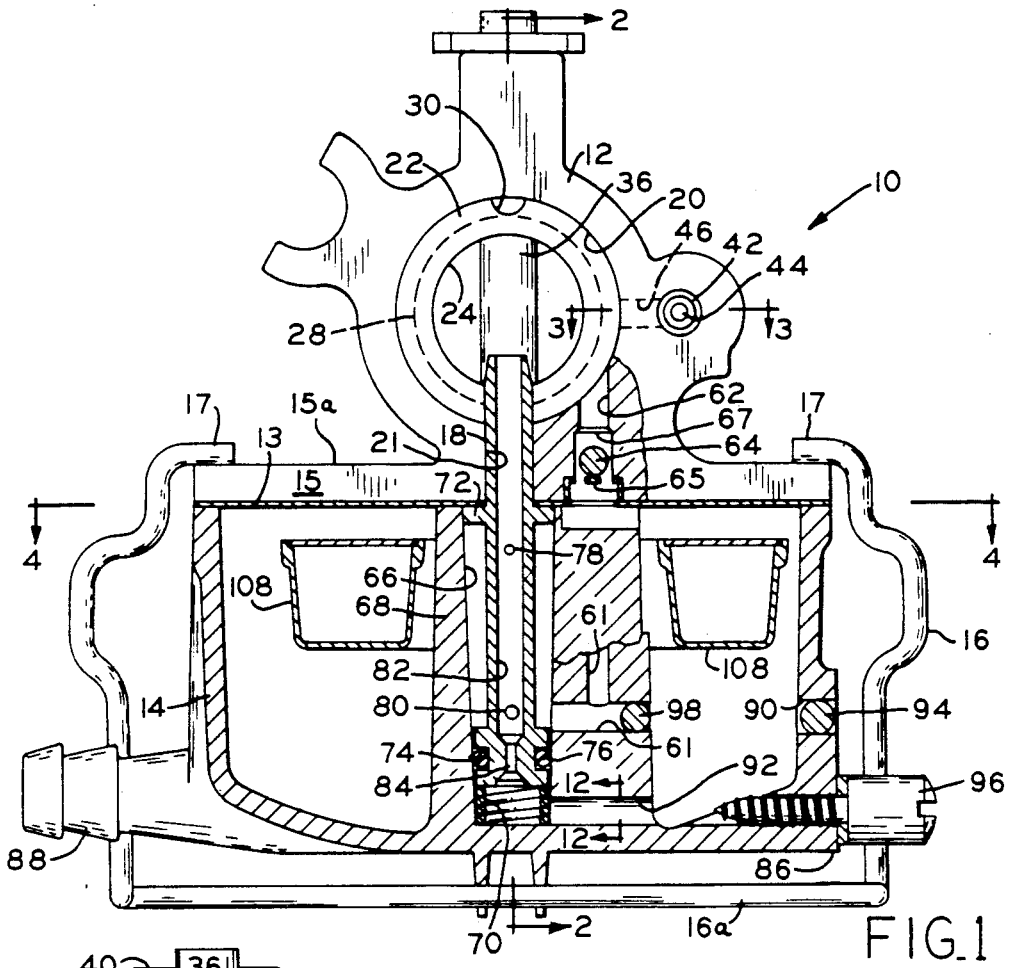
FIG. 1 is a front elevational view in cross section of a carburetor according to the present invention.
Figure 2:
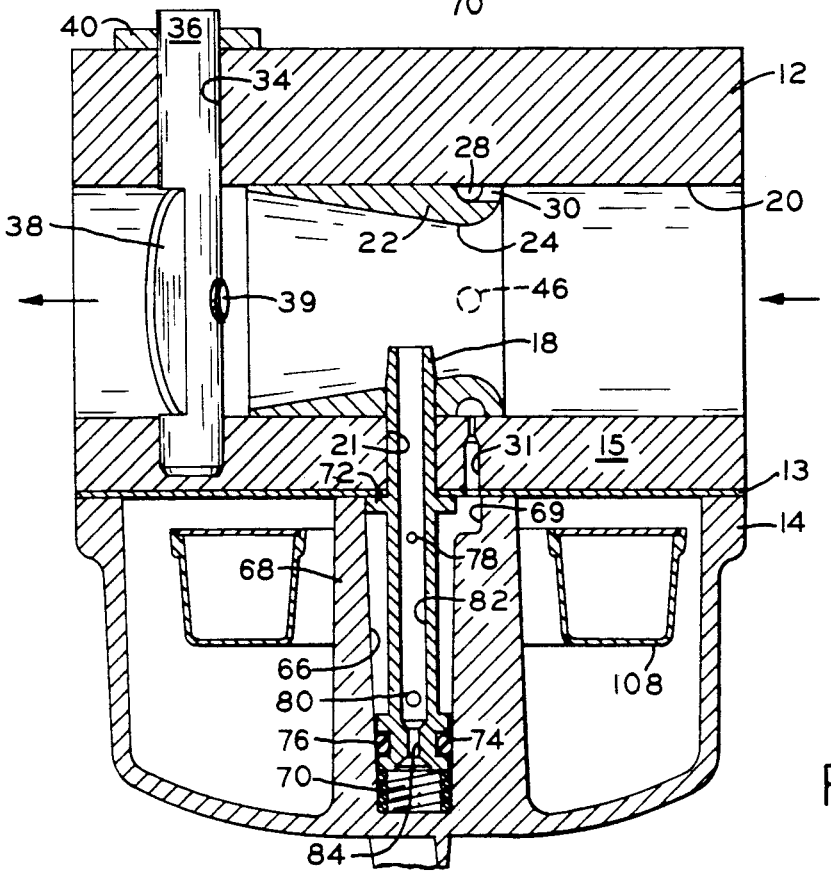
FIG. 2 is a cross-sectional view of the carburetor of FIG. 1 taken along line 2—2 thereof.

Referring to FIGS. 1 and 2, there is shown a carburetor assembly 10 including a body 12. The body is extruded and, therefore, all of the extruded body shapes are axial in nature with the axis extending from right to left as seen in FIG. 2. The body includes several machined bores, as further explained hereinafter, which bores may be machined by automatic equipment, as desired. Due to the fact that the body is extruded, it is relatively easy to machine and handle as all shapes of the extruded body are axial in nature. Another advantage of using an extruded aluminum body is that extruded aluminum is not as porous as die cast aluminum, whereby the extruded body need not be impregnated to seal it as was the case with prior art die cast aluminum carburetor bodies. Since the material of the body is aluminum, it is light in weight as is desired for small engine carburetors.

Reference is made to U.S. Patent Application Ser. No. 267,037, now U.S. Pat. No. 4,864,705, entitled METHOD OF MAKING A CARBURETOR, which application was filed on even date herewith and is assigned to the assignee of the present invention. The disclosure of that application is incorporated herein by reference.

Figure 5:
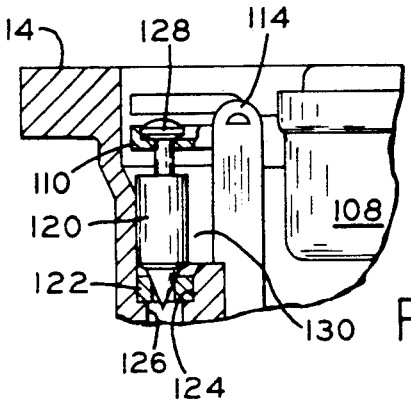
FIG. 5 is a partial cross-sectional view of the carburetor along line 5—5 of FIG. 4.
Figure 6:
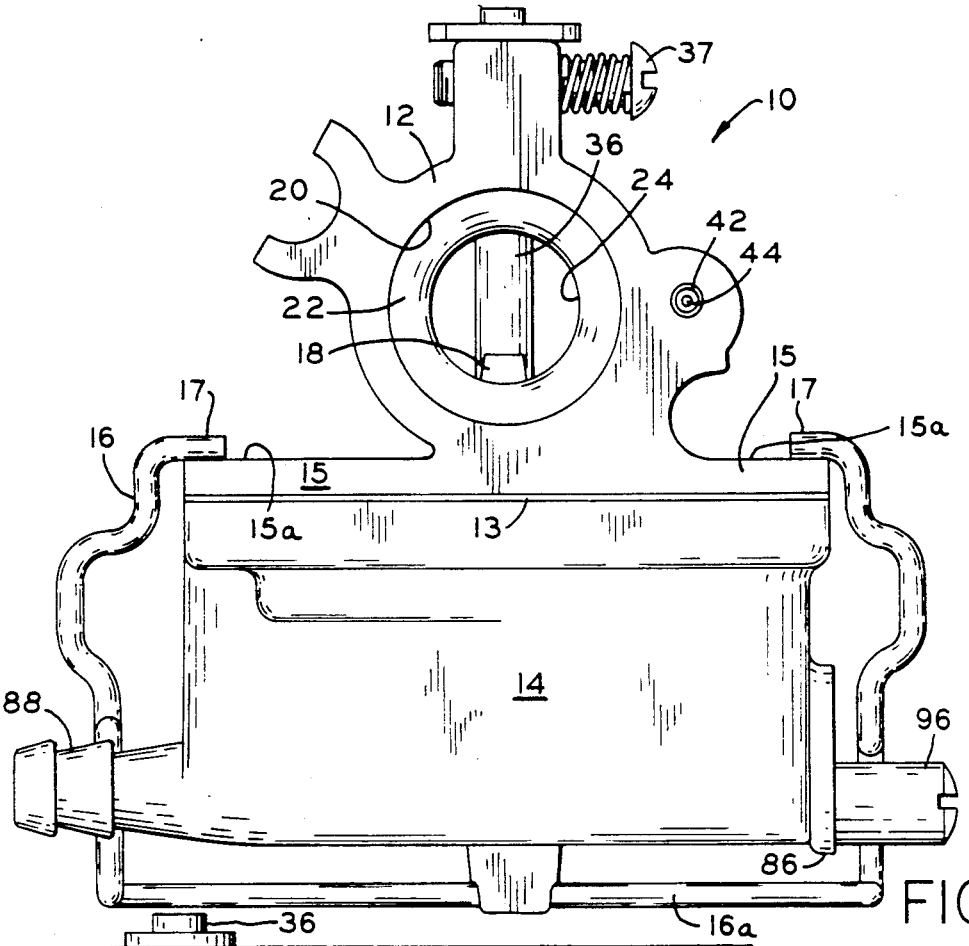
FIG. 6 is a front elevational view of the carburetor of FIG. 1.

A fuel bowl 14 is shown which, in the disclosed embodiment is made of molded plastic material. Fuel bowl 14, in the enclosed embodiment, is made from a mineral filled polyester so that it has good chemical resistance to gasoline and its by-products and has good dimensional stability. However, it should be understood that the fuel bowl may be manufactured from other plastics or cast metal and the like if desired. Fuel bowl 14 is secured to body 12 by means of a spring clip 16. Spring clip 16 (FIGS. 6 and 8) is resilient and may be made of heat treated spring steel or music wire. Thus, the spring clip may be a stamped or formed part which is then shaped and heat treated. The spring clip completely surrounds the fuel bowl and has a pair of bights 17 which engage with the shoulders 15*a* on flanges 15 of extruded aluminum body 12, or into holes in said body, as best seen in FIGS. 1 and 6. Clip 16, in the embodiment shown in FIGS. 1 through 8, comprises a spring wire having a lower portion 16*a* that engages a groove 19*a* in protruding portion 19 of fuel bowl 14. Alternatively, spring clip 16 may be of a flat design manufactured from stamped steel. A gasket 13 is inserted between flange 15 of extruded body 12 and the molded plastic fuel bowl 14, thereby sealing the fuel bowl 14 to the body 12.

Figure 7:
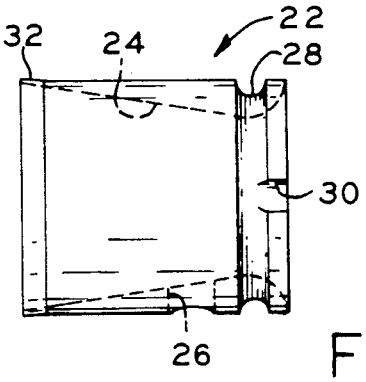
FIG. 7 is an elevational view of the venturi insert of the carburetor of FIG. 1.

A nozzle tube 18 is shown (FIG. 1) which extends from fuel bowl 14, through gasket 13, a nozzle aperture 21 in body 12 and into the through bore 20 of the carburetor body 12. The nozzle performs the function of conducting fuel from the bowl 14, as further explained hereinafter, into through bore 20 wherein it is mixed with air prior to being inducted to the engine cylinder. As best seen in FIGS. 2 and 7, a venturi insert 22 is located inside through bore 20. Venturi insert 22, in the disclosed embodiment, is formed of a molded plastic material, however, it should be understood that it may also be a cast or machined part made of aluminum or the like. Venturi insert 22 includes a venturi throat 24, a nozzle aperture 26, an annular channel or groove 28 around its exterior surface, and an axial slot or groove 30 (FIG. 7). Nozzle 18, by extending through aperture 26, locates venturi 22 in through bore 20. Additionally, by the provision of annular channel 28 and axial connecting slot 30, a continuous passage is formed with through bore 20 for conducting air from through bore 20, slot 30, annular channel 28 to a passage 31 in flange 15 to passage 69 in fuel bowl 14. By molding annular channel 28 and axial slot 30 into the venturi, machining operations to form certain passageways in the carburetor are eliminated. This reduces costs and furthermore allows flexibility in that different size venturi inserts may be used with the same size body 12, thus reducing inventory.

As best seen in FIG. 7, venturi insert 22 also includes an outwardly tapered lip portion 32 at the trailing end thereof. This tapered portion 32 has a slightly larger outer diameter than the diameter of the main portion of venturi insert 22. By virtue of this slightly larger outside diameter, taper 32 will seal venturi 22 against the wall of through bore 20, thereby eliminating any leakage around the venturi insert 22.

Referring further to FIGS. 1 and 2, a throttle shaft bore 34 is provided in body 12 for receiving a throttle shaft 36 which is secured to a throttle plate 38 by fastener 39 for controlling the fluid flow through bore 20, as is conventional. By controlling the rotation of throttle shaft 36, more or less fuel and air mixture will be drawn through bore 20 and into the engine. A dust seal washer 40 is also provided around throttle shaft 36. Attached to the throttle shaft 36 is a speed screw assembly 37 whereby the setting of the throttle shaft may be adjusted.

Figure 3:
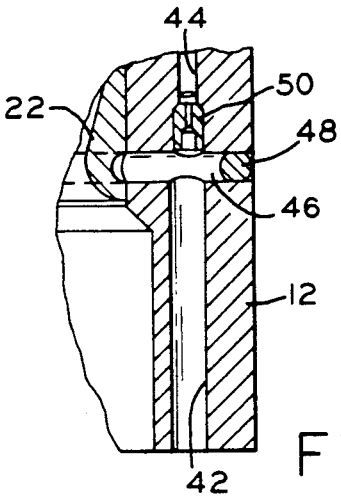
FIG. 3 is a partial cross-sectional view along line 3—3 of FIG. 1.

As can be seen in FIG. 3, additional passages 42, 44 and 46 are machined in extruded body 12. A plug 48 is then inserted into the end of passage 46 and a restrictor 50 is inserted into passage 42. Restrictor 50 functions with the idle system to limit the air entering the idle system. The fuel well is vented through passage 31, channel 28, and passages 46 and 42.

Figure 8:
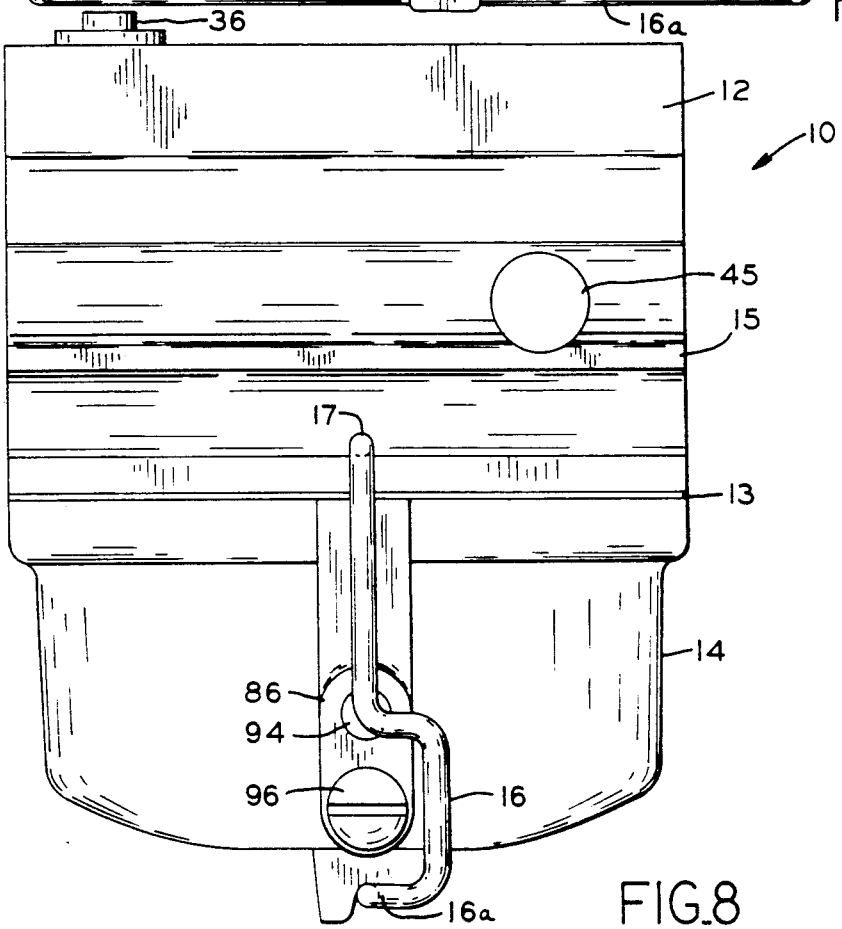
FIG. 8 is a side elevational view of the carburetor of FIG. 1 taken from the right side thereof.

Referring to FIG. 8, a bore 45 is shown in the extruded body 12. This bore is covered with a Welch plug and connects to passage 44 (FIGS. 1 and 3) whereby passage 44 is provided with air. The carburetor may be provided with a primer comprising a remote primer bulb connected to the bowl of the carburetor by a tube (not shown) in a manner well known in the art. It should be noted that the carburetor may be manufactured with either a priming system or a choke system and if the carburetor includes a priming system, the choke system may be eliminated from the carburetor. If the mixing screw system is included, then the orifice 84 (FIGS. 1 and 2) is not needed. The same carburetor body 12 and fuel bowl 14 may be used and adapted to provide both types of systems.

When the primer bulb is depressed, air will flow through into the fuel bowl thereby pressurizing the fuel bowl. As the fuel bowl is pressurized, ball valve 64, which normally rests on a stop 65, will be forced upwardly against seat 67, thereby preventing the positive pressure in the fuel bowl caused by depression of the primer bulb (not shown) from escaping through vent 62.

Well 66 is formed by a wall 68 and is vented by means of a passage 69 which connects with air passage 31. A compression spring 70 is located in the bottom of well 66 and urges nozzle 18 upwardly so that shoulder 72 of nozzle 18 is in engagement with gasket 13, thereby sealing nozzle 18 to the body 12 and preventing fuel from flowing upwardly through bore 21 through which nozzle 18 extends into body 12.

Nozzle 18 includes a groove 74 near its lower end for receiving an O-ring 76 whereby the inlet of nozzle 18 is sealed in well 66. Thus, no fuel can flow from the lower portion of well 66 past nozzle 18 into the upper portion of well 66. Nozzle 18 is hollow and includes a nozzle passage 82 and two apertures 78 and 80. In the embodiment of FIGS. 1 - 8, the lower portion of nozzle passage 82 has a reduced diameter to form a jet or metering orifice indicated at 84. Fuel bowl 14 includes two further passages 90 and 92 which extend through mixing screw housing 86. Mixing screw housing 86 is an integral part of molded fuel bowl 14. Passages 92 and 90 are open to the fuel bowl and also extend through wall 68. Thus fuel which collects in fuel bowl 14 may flow through passage 92 into the lower portion of well 66 after which it is drawn upwardly through metering jet 84 into nozzle passage 82. A screw 96 is received in float bowl 14. It should be noted that a plug 98 prevents fuel from flowing from the bowl through passage 61 into well 66. Plug 94 blocks passage 90, thereby preventing fuel from flowing out of fuel bowl 14. As further explained hereinafter, passages 90 and 92 are used to house mixture screws in the adjustable embodiment of the carburetor. In the embodiment of FIGS. 1–8, fuel flows from bowl 14 into well 66 and is metered through jet 84 from well 66 into nozzle passage 82 and is drawn upwardly into venturi throat 24. Air is drawn into nozzle passage 82 through apertures 78 and 80. When the primer bulb is activated, the pressure generated in fuel bowl 14 will pressurize the fuel in nozzle passage 82 whereby fuel will be squirted into venturi throat 24. However, due to the difference in size between passage 31 and nozzle passage 82, little fuel will pass upwardly from well 66 into channel 28.

Figure 4:
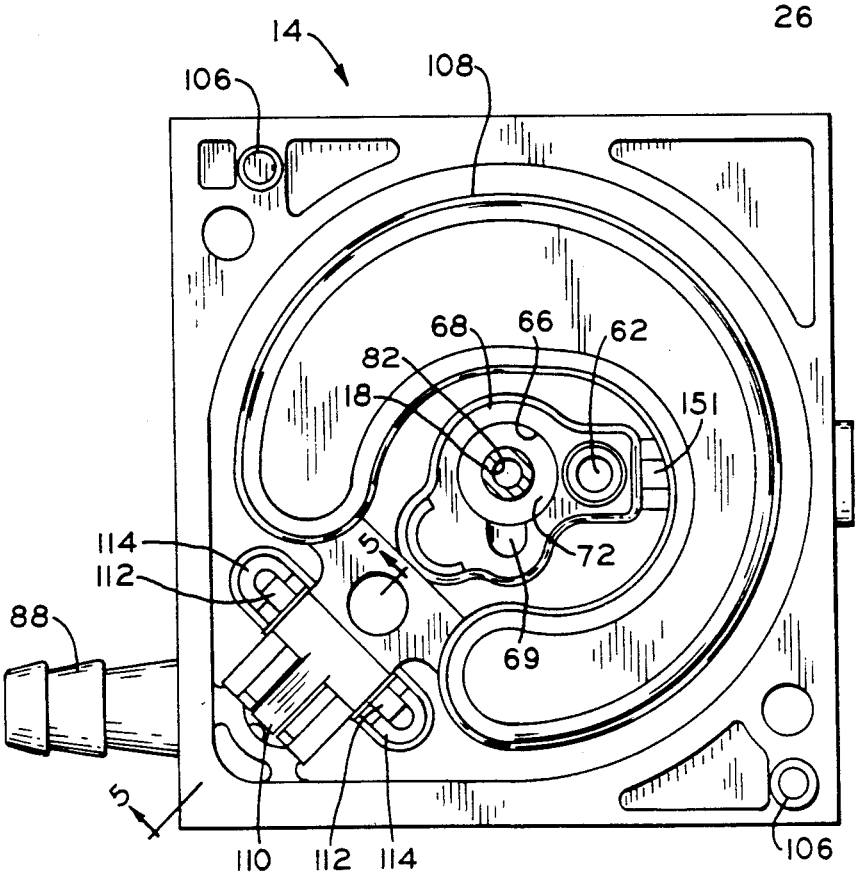
FIG. 4 is a cross-sectional view of the carburetor of FIG. 1 along line 4—4 thereof.

The entire fuel bowl assembly 14 is located with respect to the body 12 by means of a pair of locating studs 106, best shown in FIG. 4. As seen in FIG. 5, a float 108 is located inside fuel bowl 14 and functions in well-known manner to operate a needle valve 120 for maintaining the fuel supply in fuel bowl 14 at a predetermined level.

Float 108 is a two-piece, heat sealed acetal plastic and includes a float arm 110 and a pivot pin 112, which is received in cradle 114. The float pin 112 is snapped into the cradle 114 and is retained therein. Thus, as float 108 moves upwardly or downwardly, depending upon the level of fuel in bowl 14, arm 110, which is attached to needle valve 120, causes the valve to open and close to control the flow of fuel into bowl 14.

Referring to FIG. 5, the needle valve assembly is shown in detail. Needle valve 120 including valve stem 128 is retained in a cavity of float arm 110. Needle valve 120 is provided with a seat 122 which is located in an aperture 124. Seat 122 may be made of a flexible and resilient material such as fluorocarbon rubber, such as Viton made by DuPont, and is pressed into aperture 124. Fuel flows through passage 126 and, when the needle valve 120 moves upwardly because float 108 drops due to a low level of fuel in bowl 14, permits fuel to flow past needle valve 120 and into bowl 14. Needle valve 120 operates inside a locator tube 130, which is directly molded in the fuel bowl. Tube 130 includes an axial slot (not shown) to permit needle locator tube 130 to drain therefrom and to flow better.

In operation, extruded body 12 is secured to fuel bowl assembly 14 and is sealed thereto by means of gasket 13. Spring clip 16 resiliently secures the fuel bowl 14 assembly to body 12. Fuel flows into the fuel bowl through fuel inlet 88. The fuel level in bowl 14 is controlled by means of float 108 and needle valve 120. Fuel flows into the bottom portion of well 66 through passage 92. Spring 70 maintains fuel nozzle 18 in sealing contact with gasket 13. Fuel is metered through jet 84 and is drawn into the throat of venturi 24. Fuel bowl 14 is vented by means of passage 62, annular groove 28, and connecting axial passage 30 into through bore 20 of body 12. When the primer bulb is depressed, fuel will be squirted into throat 24 of venturi 22.

Most servicing of the carburetor can be accomplished by removing the bowl and leaving the remainder of the carburetor attached to the engine. Thus, for most servicing only spring clip 16 need be swung out of the way, which permits bowl 14 to be detached from the carburetor body 12 and all linkages to the body 12 can remain intact. Thus, float 108, inlet valve 120, and all other parts of the bowl 14 may be cleaned without readjusting the linkages to the carburetor body 12.

Figure 11:
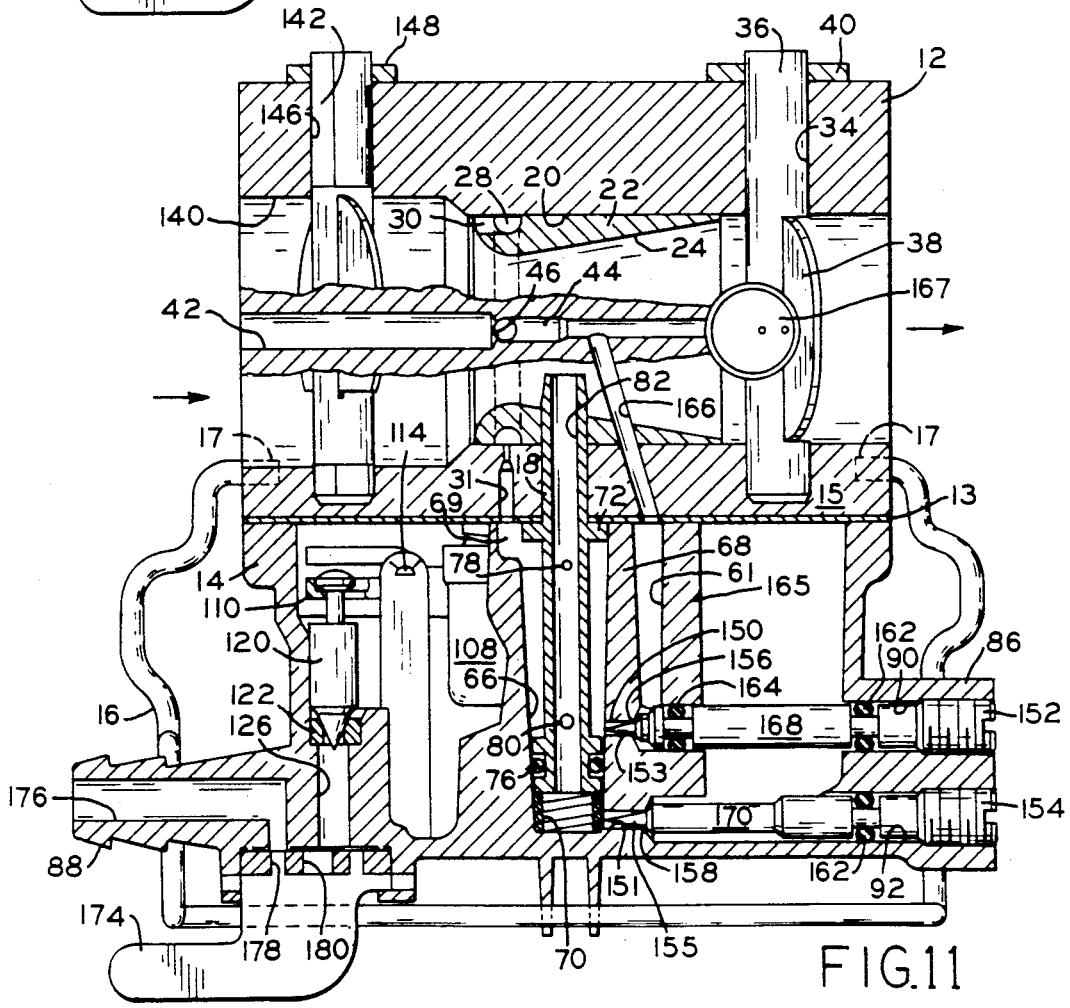
FIG. 11 is a cross-sectional elevational view of the carburetor of FIG. 9 with the body portion rotated 90° for the sake of illustration.
Figure 12:
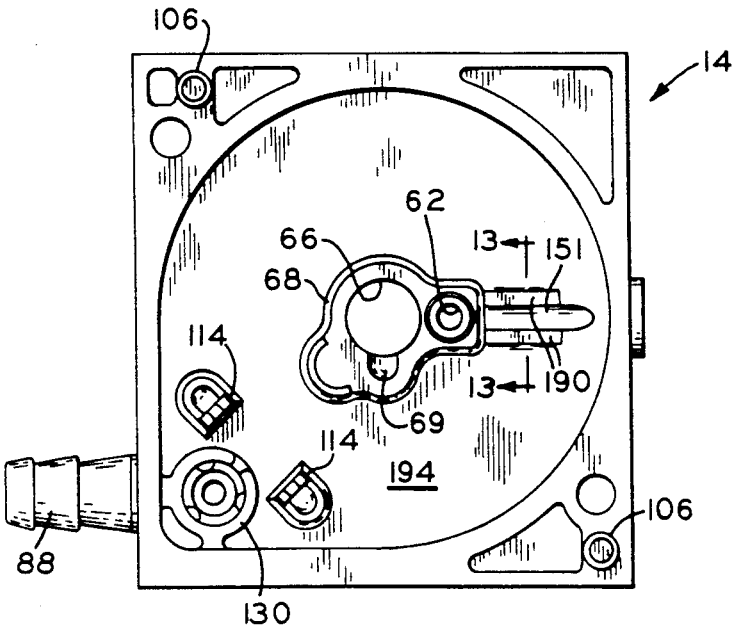
FIG. 12 is a top plan view of the fuel bowl of the carburetor of FIG. 1.
Figure 13:
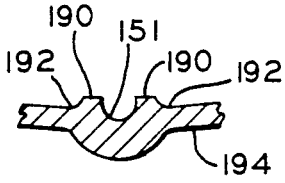
FIG. 13 is a partial cross sectional view of the fuel bowl of FIG. 12 taken along line 13—13 thereof.

Referring now to FIGS. 12 and 13, it can be seen that the bottom of the fuel bowl molding includes a pair of raised portions or shoulders 190 on either side of groove 151 whereby pockets 192 are formed. Fuel will therefore flow over the bottom of the fuel bowl 194 and overflow shoulders 190 after which it flows through groove 151 into the bottom of well 66. However, any dirt in the gasoline will be trapped in pockets 192 and therefore will not flow into the well 66, thereby preventing clogging of orifice 158 (see FIG. 11) and other passages in nozzle 18.

Figure 9:
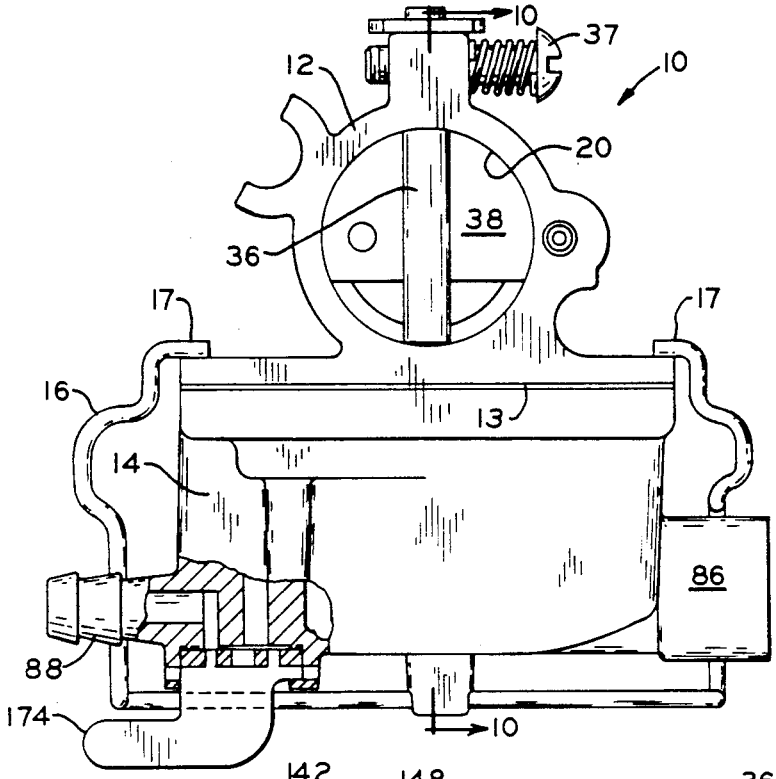
FIG. 9 is a front elevational view in cross section of another embodiment of the carburetor according to the present invention.
Figure 10:
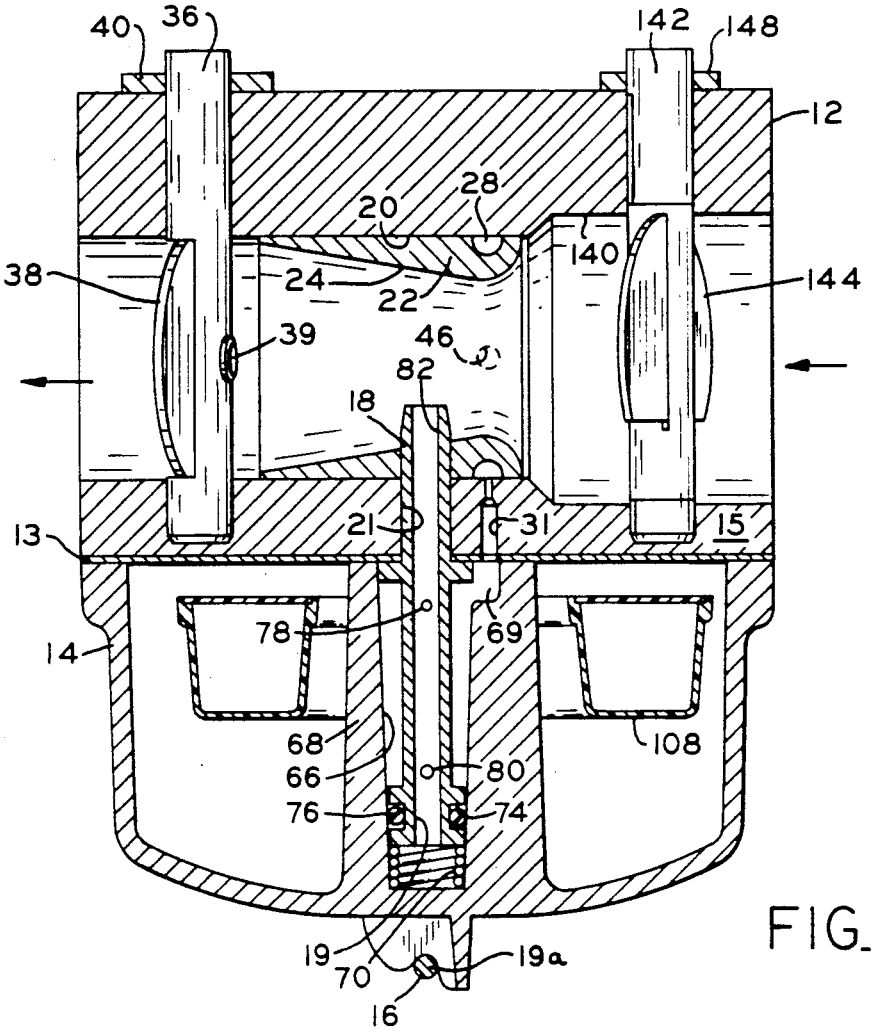
FIG. 10 is a cross sectional view of the carburetor of FIG. 9 taken along line 10—10 thereof.

Referring now to FIGS. 9, 10 and 11, an alternative embodiment of the invention is shown including idle and power mixture adjusting screws. In this embodiment, the through bore 20 in body 12 is machined out to a larger diameter at the choke end of the carburetor as shown at 140. The choke shaft 142 is inserted through an aperture 146 in body 12 and a choke plate 144 is secured to choke shaft 142 whereby the air flow into the carburetor may be regulated for cold starting as is customary. The larger bore 140 is provided to make up for the space taken up by the choke shaft and choke plate whereby the amount of air which can be taken into the carburetor is not reduced. A washer 148 is provided around shaft 142 to seal the shaft to body 12.

In this embodiment, adjusting screws 152 and 154 are provided for the carburetor. 152 is the idle mixture screw and 154 is the power mixture screw. Screws 152 and 154 include self tapping threads whereby mixing screw housing 86 does not need to be provided with threads during molding thereof. Screws 152 and 154 include conical tips 153 and 155 which form orifices 156 and 158 in apertures 150 and 151 when they are driven in to their limits. The tips 153 and 155 are configured, with an annular shoulder to act as a stop, so that they cannot be driven too far into apertures 150 and 151. Screws 152 and 154 respectively include stems 168 and 170.

It should be noted that the idle and power mixture adjusting screws are located together whereby all of the controls, including the adjusting screws and the fuel valve 174 are located in the same general area of the carburetor whereby access to and serviceability of the carburetor is much improved.

Stems 168 and 170 of respective screws 152 and 154 are sealed to passages 90 and 92 by means of O-rings 162 to prevent fuel from leaking out of bowl 14. Additionally, an O-ring 164 seals the stem of screw 152 to wall 165, thereby preventing fuel from leaking out of bowl 14 into passage 61. It should also be noted that in this embodiment nozzle 18 does not include a metering jet aperture. Metering is accomplished by screws 152 and 154. Thus, in the idle mode, fuel from bowl 14 may pass through annular orifice 158, passage 151 into the bottom of well 66, thence into nozzle passage 82 through aperture 80 into well 66, thence through passage 150 and annular orifice 156 into passage 61 and from there by means of idle passage 166 and passage 42, into the idle pocket 167 and through several small holes drilled into bore 20 and then into the engine. A Welch plug is provided to cover and seal idle pocket 167.

In this embodiment, a fuel valve 174 is also shown as part of the fuel bowl assembly. Valve 174 includes passages 178 and 180 for connecting respectively to fuel inflow passage 176 and fuel outflow passage 126. Thus with the valve 174 in the position as shown, fuel can flow from the inlet 88 directly to the needle valve 120. However, when the valve 174 is rotated, the flow of fuel is interrupted.

The carburetor of FIGS. 9, 10 and 11 operates in much the same way as the carburetor of FIGS. 1-8 with the exception that the choke plate 144 as well as the idle and power mixture adjusting screws 152 and 154 are all adjustable. Thus control over the flow of fuel to the engine may be accomplished by the use of those controls as well as the throttle valve 38.

In the embodiment of FIGS. 9-11, similarly to the embodiment of FIGS. 1-8, the entire fuel bowl assembly including the adjusting screws and fuel valve 174 may be removed as a unit simply by removing spring clip 16. However the linkages for controlling the carburetor throttle valve and choke do not need to be loosened in order to remove the fuel bowl assembly. Thus serviceability is considerably improved over prior art While this invention has been described as having a preferred design, it will be understood that it is capable of further modifications. This application is therefore intended to cover any variations, uses or adaptations of the invention following the general principles thereof and including such departures from the present disclosure as come within known or customary practice in the art to which this invention pertains and fall within the limits of the appended claims.

What is claimed is:

1. A carburetor assembly comprising:

an extruded body, said body including a through passage having an air inlet;

a fuel bowl secured to said body;

means for conducting fuel from said bowl into said through passage; and a generally cylindrical venturi member mounted in said through passage, said fuel conducting means adapted to conduct fuel into said venturi member;

wherein said venturi member is a generally cylindrical member, one end portion of said member being resilient and having a radially outwardly tapered circumference, whereby said one end portion, upon insertion of said venturi member into said through passage, is deflected inwardly and forms a circumferential seal with said through passage.

2. A carburetor assembly comprising:

an extruded body, said body including a through passage having an air inlet;

a fuel bowl secured to said body; and means for conducting fuel from said bowl into said through passage;

wherein said venturi member is a generally cylindrical member having an annular groove around its outer circumference, said venturi member further including an axial groove in its outer circumference, said axial groove being interconnected with said annular groove, said annular groove and axial groove forming respectively an annular channel and an axial chamber with said through passage, said annular channel being interconnected with said fuel bowl by a generally radial passage in said extruded body, and said axial channel being open to said through passage.

3. A carburetor assembly comprising:

an extruded body, said body including a through passage having an air inlet;

a fuel bowl secured to said body;

means for conducting fuel from said bowl into said through passage; and a resilient spring means for urging said means for conducting into sealing engagement with said extruded body.

4. A carburetor assembly comprising:

an extruded body including a through passage therein adapted to admit air into said body;

a venturi member mounted in said passage;

a fuel bowl;

a resilient clip means for securing said fuel bowl to said body; and nozzle means for conducting fuel from said fuel bowl into said venturi member;

wherein said venturi member is a generally cylindrical member, one edge portion of said venturi member being resilient and having a radially outwardly tapered circumference, whereby said one edge portion, upon insertion of said venturi member into said passage, is deflected inwardly and forms a circumferential seal with said passage.

5. A carburetor assembly comprising:

an extruded body including a through passage therein adapted to admit air into said body;

a venturi member mounted in said passage;

a fuel bowl;

a resilient clip means for securing said fuel bowl to said body; and nozzle means for conducting fuel from said fuel bowl into said venturi member;

wherein said venturi member is a generally cylindrical member having an annular groove around its outer circumference, said venturi member further including an axial groove in its outer circumference, said axial groove being interconnected with said annular groove, said annular groove and axial groove forming a respective annular channel and axial channel with said through passage, said annular channel interconnected with said fuel bowl by a generally radial passage in said body and said axial channel being open to said through passage.

6. A carburetor assembly comprising: a body including a through passage therein adapted to admit air into said body; a venturi member mounted in said passage; a fuel bowl; a resilient clip means for securing said fuel bowl to said body; nozzle means for conducting fuel from said fuel bowl into said venturi member; and a well integrally molded into said bowl, wherein said nozzle means comprises a tube that extends into said well, said tube being resiliently sealingly urged against said body by a spring, said tube being sealed against said well by an O-ring disposed between said tube and said well.

7. A carburetor assembly comprising:

an extruded body including a through passage therein adapted to admit air into said body;

a venturi member mounted in said passage;

a fuel bowl;

a resilient clip means for securing said fuel bowl to said body; and nozzle means for conducting fuel from said fuel bowl into said venturi member;

wherein said fuel bowl assembly is molded from plastic and includes an idle mixture screw aperture and a main mixture screw aperture, an idle screw with self-tapping threads being threadedly received in said idle screw aperture, a main mixture screw with self-tapping threads being threadedly received in said screw aperture.

8. A carburetor assembly comprising:

an extruded body, said body including a through passage having an air inlet;

a fuel bowl secured to said body; and means for conducting fuel from said bowl into said through passage;

wherein said fuel bowl is molded from plastic and includes a fuel reservoir, an idle mixture adjusting screw aperture and a main mixture adjusting screw aperture, an idle screw with self-tapping threads threadedly received in said idle screw aperture, and a main screw with self-tapping threads threadedly received in said main screw aperture.

9. The assembly according to claim 8 wherein said fuel bowl assembly includes a well formed by an upstanding wall, said wall including an aperture therein adapted to receive a tip of said metering screw, said tip adapted for forming said aperture into an orifice.

10. The assembly according to claim 8 wherein said idle and main adjusting screws extend through at least a portion of the fuel reservoir of said bowl.

11. A carburetor assembly comprising:

a body, said body including a through passage having an air inlet and a fuel-air outlet, said body including an inner surface;

a generally cylindrical venturi member axially mounted in said through passage, said venturi member having a generally cylindrical outer surface that extends around said through passage inner surface and having a radial opening therein;

a fuel bowl secured to said body; and fuel conducting means comprising a nozzle member that extends from said bowl through said body into said radial opening for conducting fuel from said bowl to said venturi member, said venturi member including a groove in its outer surface forming with said passage inner surface a channel, said channel being interconnected with said fuel bowl by a passage in said body, said channel being open to said through passage.

12. The carburetor assembly of claim 11 including resilient clip means for securing said fuel bowl to said extruded body.

13. The carburetor assembly of claim 12 wherein said resilient clip means comprises a resilient member having ends that engage an upper surface of said body, wherein said clip means extends underneath and supports said bowl.

14. A carburetor comprising:

an extruded body including a through passage therein adapted to admit air into said body, said body including a pair of flanges extending parallel to said through passage, said flanges defining shoulders;

a venturi member mounted in said passage;

a fuel bowl including a well integrally formed therein;

a resilient clip means for securing said fuel bowl to said body, said clip means including a pair of bights that are seated on said shoulders and are connected by a center portion of said clip means that extends under said bowl to thereby clamp said bowl to said body; and a nozzle tube having a lower end extending into said well and an upper end extending into said venturi member, said nozzle tube being clamped by said bowl to said body member.

15. The carburetor of claim 14 including a spring that resiliently urges the nozzle tube against said body, said tube being sealed against the well by means of an O-ring disposed between the tube and well.

16. The carburetor of claim 14 wherein said venturi member includes a radial passageway, and said nozzle tube extends through said radial passageway.

17. The carburetor of claim 14 wherein said well is formed by an upstanding surface in said fuel bowl, said fuel bowl having an outer wall defining a fuel reservoir, the wall of said well including an aperture therein that receives a tip of a metering screw, said tip and said aperture together defining an orifice.

18. The carburetor of claim 17 wherein said screw extends from said bowl outer wall and through said reservoir to said upstanding wall.

19. A carburetor assembly comprising:

a body, said body including a through passage having an air inlet;

means for conducting fuel from said bowl into said through passage; and a generally cylindrical venturi member mounted in said through passage, said fuel conducting means adapted to conduct fuel into said venturi member, said venturi member including an annular lip portion that is resiliently urged radially outward against said through passage to form a circumferential seal with said through passage;

said venturi member including a radial passageway, said means for conducting comprising a tubular member which connects with said radial passageway.

20. The assembly according to claim 19 wherein said venturi member is a molded plastic member.

21. The assembly according to claim 19 wherein said through passage includes an outlet, the cross sectional area of said inlet being greater than the cross sectional area of said outlet.

22. The assembly according to claim 19 wherein a pocket member is formed in the bottom of said fuel bowl for capturing foreign particles therein and preventing said foreign particles from entering said means for conducting.

23. The assembly according to claim 19 wherein said means for conducting comprises a tube, a first end of said tube forming a nozzle and extending into said through passage, a second end of said tube including a jet aperture means for metering fuel into said tube second end.

24. The assembly according to claim 19 wherein said fuel bowl includes a fuel shut-off valve.

25. The carburetor assembly of claim 19 wherein said tubular member extends through said radial passageway.

26. The assembly according to claim 19 wherein said fuel bowl is molded from plastic.

27. The assembly according to claim 26 including a well member integrally molded in said fuel bowl.

28. The assembly according to claim 19 including a well member integrally molded in said fuel bowl, said means for conducting comprising a tubular nozzle member having one end thereof disposed in said well.

29. The assembly according to claim 28 wherein said means for conducting comprises a tube, said tube being resiliently sealingly urged against said body by a spring, and an O-ring disposed between said tube and said well for sealing said tube against the wall of said well.

30. The assembly according to claim 28 wherein said means for conducting comprises a plastic tube, said tube having a first end extending into said well and a second end extending through a radial passage in said venturi member into said through passage thereby axially locating said venturi, said tube first end sealed against a wall of said well by an O-ring disposed between said wall and tube, said tube including a radial aperture for admitting air into said tube, said tube first end being open and adapted to admit fuel into said tube.

31. The assembly according to claim 19 including resilient clip means for securing said fuel bowl to said extruded body.

32. The assembly according to claim 31 wherein said resilient clip means comprises a resilient member having ends that engage an upper surface of said extruded body, wherein said clip means extends underneath and supports said bowl.

33. The carburetor assembly of claim 19 wherein said body is extruded.

34. The assembly according to claim 33 wherein said extruded body is made of aluminum.

* * * * *

UNITED STATES PATENT AND TRADEMARK OFFICE

CERTIFICATE OF CORRECTION

PATENT NO. : 5,049,318

DATED : September 17, 1991

INVENTOR(S) : Thomas G. Guntly et al

It is certified that error appears in the above-identified patent and that said Letters Patent is hereby corrected as shown below:

Claim 2, column 9, line 34, delete "chamber" and substitute therefor --channel--.

Claim 19, column 11, line 60, after "inlet;" insert the following subparagraph:

--a fuel bowl secured to said body;--

Signed and Sealed this

Nineteenth Day of January, 1993

*Attest:*

DOUGLAS B. COMER

*Attesting Officer*

*Acting Commissioner of Patents and Trademarks*